US010098450B1

(12) United States Patent
Brewer et al.

(10) Patent No.: US 10,098,450 B1
(45) Date of Patent: Oct. 16, 2018

(54) FOLDABLE TRAY SYSTEM

(71) Applicants: Amber Brewer, Riverhead, NY (US); Laura Brewer, Riverhead, NY (US)

(72) Inventors: Amber Brewer, Riverhead, NY (US); Laura Brewer, Riverhead, NY (US)

( * ) Notice: Subject to any disclaimer, the term of this patent is extended or adjusted under 35 U.S.C. 154(b) by 0 days.

(21) Appl. No.: 15/841,468

(22) Filed: Dec. 14, 2017

(51) Int. Cl.
*A47B 5/02* (2006.01)
*A47D 3/00* (2006.01)

(52) U.S. Cl.
CPC . *A47B 5/02* (2013.01); *A47D 3/00* (2013.01)

(58) Field of Classification Search
CPC ..... A47B 5/02; A47D 3/00
See application file for complete search history.

(56) References Cited

U.S. PATENT DOCUMENTS 4,570,803 A * 2/1986 Peterson ..... A47B 5/02 108/47
7,716,749 B2 * 5/2010 Perazzo ..... A41B 13/106 2/49.1
2001/0035112 A1 * 11/2001 Guard ..... A47D 1/008 108/25
2006/0180058 A1 * 8/2006 Monson ..... A47B 5/02 108/152
2007/0265144 A1 * 11/2007 Jackson ..... A47B 83/02 482/68
2008/0149580 A1 * 6/2008 Hill ..... A47B 13/16 211/126.1
2009/0200841 A1 * 8/2009 Rhoten ..... A47D 1/00 297/157.1
2014/0345499 A1 * 11/2014 Wilson ..... A47B 23/04 108/25
2015/0090162 A1 * 4/2015 Vlosich ..... A45C 11/00 108/18
2015/0108123 A1 * 4/2015 Linehan ..... A47D 3/00 220/17.1
2016/0120301 A1 * 5/2016 Cross ..... A47B 13/003 320/101
2016/0325197 A1 * 11/2016 Smith ..... A63H 33/006
2016/0353877 A1 * 12/2016 Brus ..... A47B 5/02
2017/0150837 A1 * 6/2017 Flannery ..... A47G 23/0608
2017/0311712 A1 * 11/2017 Walker ..... A47B 31/04
2017/0332794 A1 * 11/2017 Melaragno ..... A47C 7/70

* cited by examiner

*Primary Examiner* — Hanh V Tran
(74) *Attorney, Agent, or Firm* — Carter, DeLuca, Farrell & Schmidt, LLP

(57) ABSTRACT

A tray system including a tray; a pad coupled to a proximal end of the tray; a lip having a U-shaped configuration, the lip extending away from a top surface of the tray, the lip located adjacent a periphery of a bottom surface of the tray; and a plurality of fixing elements extending from the top surface. The plurality of fixing elements includes a pair of substantially elongated protrusions extending away from the top surface; and a circular loop. The tray system includes an anchoring system hinged to the bottom surface of the tray and includes at least one clamp. Each clamp includes a proximal portion having a C-shaped frame defining a first end; a distal portion integrally connected to and extending from the proximal portion, the distal portion defining a G-shaped clamp and configured as a resilient arm; and a screw threadably connected to the resilient arm.

20 Claims, 2 Drawing Sheets

FOLDABLE TRAY SYSTEM

BACKGROUND

Field of the Invention

The present disclosure relates to an attachable multi-purpose tray for supporting objects, more specifically, this disclosure relates to an easy compact hook-on tray for children particularly designed to be removably attached to a horizontal surface such as a counter top or table, and further providing a surface where a child can eat and play.

Background of Invention

In general trays are considered to be substantially shallow platforms designed for the carrying of items. Trays are broadly used to contain items, some trays have an edge that is raised such that if a substance such as a liquid is spilled on the surface on the tray, the substance will not run off onto the floor. For the case of articles such as cups or toys, the edge can serve as a barrier to prevent the items from leaving the surface.

Many situations exist where food dishes or other articles can spill, fall, or otherwise be broken due to the articles not being securely held. For example, a child enjoying a meal at a restaurant may knock a cup down or push a dish off the table. In addition, having a child eat from a plate placed directly onto a table surface can have negative consequences for the child and the table. For example, the table surface may be unsanitary or contaminated with chemicals to which children may be susceptible to. In another example, a child may cause damage to the surface of the table.

In general children are known to not stay put while eating, especially younger children. Younger children tend to be have less control of their motricity, more specifically, younger children are known for not having full control of the use of their hands which makes spills and the dropping of handle items more frequent. Thus, within the tray industry there are available trays that are designed specifically for the use of children.

However, a drawback of current children trays is the lack of specific elements and features which are a must have when it comes to buying a tray that will be used by younger children. One specific type of element that current children trays lack are elements to keep toys fixated to the surface of the tray, another specific element is a feature to hold media players like smart phones or tables which are desired accessories for use by parents. For example, many most parents carry smart phones, thus, trays having elements that may help fixate or at least enable resting of their smart phone or media device in front of their children are desired.

Another drawback of current trays is their lack of foldability, more specifically, in instances the overall design of trays includes anchoring elements directed to be used when fixation of the tray is needed, however; these anchoring element are not foldable or storable.

Thus, there is a need for a type of tray that does not lack specific features like the ones mentioned above, and further elements in general that are suitable for the use of younger children such as toddler and/or infants.

SUMMARY

In accordance with an aspect of the present disclosure, a tray system is provided and includes a tray defining a bottom surface, a top surface, a proximal end, and a distal end; a pad configured to couple to the proximal end of the tray, the pad having a substantially cylindrical shape; a lip having a U-shaped configuration, the lip extending away from the top surface of the tray, the lip located adjacent a periphery of the bottom surface of the tray; and a plurality of fixing elements extending from the top surface of the tray.

The plurality of fixing elements includes a pair of substantially elongated protrusions extending away from the top surface; and a circular loop.

The tray system further includes an anchoring system hinged to the bottom surface of the tray and configured to connect to opposed surfaces of a substantially flat surface, the anchoring system including at least one clamp.

Each clamp includes a proximal portion having a C-shaped frame defining a first end; a distal portion integrally connected to and extending from the proximal portion, the distal portion defining a G-shaped clamp and configured as a resilient arm; and a screw threadably connected to the resilient arm.

The anchoring system may include a pair of clamps hingedly connected to the bottom surface of the tray.

The plurality of fixing elements may be removable.

The pad may be hollow and may be configured and dimensioned to store the plurality of removable fixing elements.

Each clamp of the anchoring system may be foldable between a collapsed condition and an extended condition.

The pair of substantially elongated protrusions of the plurality of fixing elements may include a first elongated protrusion disposed adjacent the distal end of the tray; and a second elongated protrusion disposed adjacent the first elongated protrusion.

The first elongated protrusion and the second elongated protrusion of the plurality of fixing elements may be spaced apart from one another and extend parallel to one another.

The first elongated protrusion and the second elongated protrusion of the plurality of fixing elements may extend substantially parallel to the distal end of the tray.

The first elongated protrusion of the plurality of fixing elements may have a height, and the second elongated protrusion of the plurality of fixing elements may have a height which is less than the height of the first elongated protrusion.

The first elongated protrusion of the plurality of fixing elements may include a proximal wall facing the second elongated protrusion of the plurality of fixing elements. The proximal wall may be angled and extends away from the second elongated protrusion of the plurality of fixing elements.

The circular loop of the plurality of fixing elements may be located adjacent a lateral side edge of the tray.

The circular loop of the plurality of fixing elements may be located between first and second protrusions of the plurality of fixing elements and the pad.

In an embodiment, a first clamp of the pair of clamps of the anchoring system may be located adjacent a first lateral side of the tray, and a second clamp of the pair of clamps of the anchoring system may be located adjacent a second lateral side of the tray.

Each clamp of the anchoring system may be foldable between a collapsed condition and an extended condition.

The pair of substantially elongated protrusions of the plurality of fixing elements may include a first elongated protrusion disposed adjacent the distal end of the tray; and a second elongated protrusion disposed adjacent the first elongated protrusion.

The first elongated protrusion and the second elongated protrusion of the plurality of fixing elements may be spaced apart from one another and may extend parallel to one another.

The first elongated protrusion and the second elongated protrusion of the plurality of fixing elements may extend substantially parallel to the distal end of the tray.

The first elongated protrusion of the plurality of fixing elements may have a height, and the second elongated protrusion of the plurality of fixing elements may have a height which is less than the height of the first elongated protrusion.

The first elongated protrusion of the plurality of fixing elements may include a proximal wall facing the second elongated protrusion of the plurality of fixing elements, wherein the proximal wall may be angled and may extend away from the second elongated protrusion of the plurality of fixing elements.

The circular loop of the plurality of fixing elements may be located adjacent a lateral side edge of the tray. The circular loop of the plurality of fixing elements may be located between first and second protrusions of the plurality of fixing elements and the pad.

DETAILED DESCRIPTION

Figure 1:
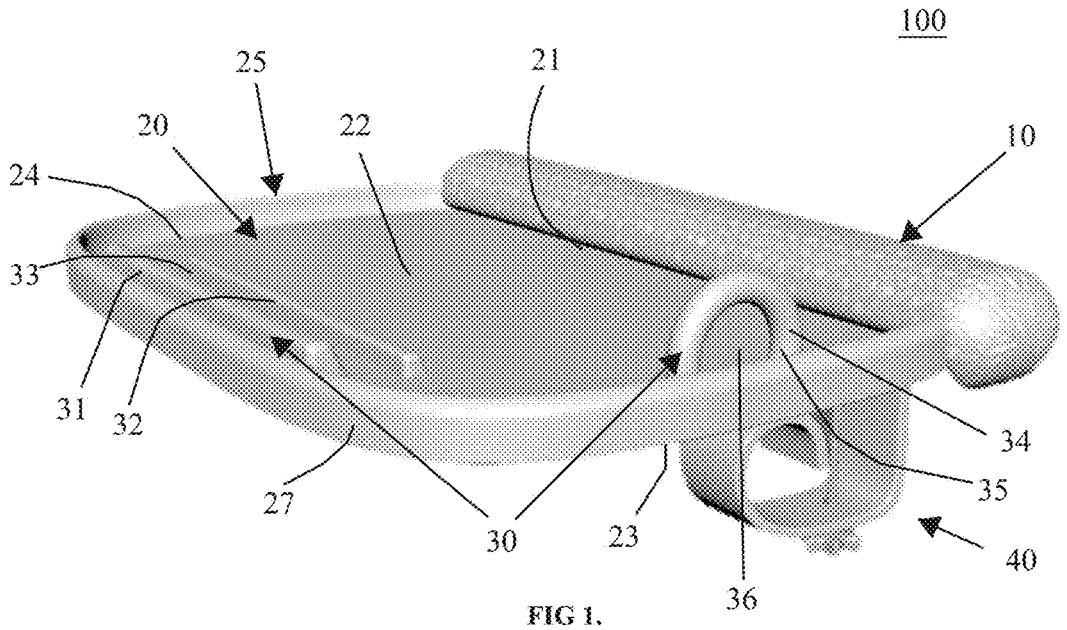
FIG. 1 is an illustration of a front perspective view of a tray system in accordance with an embodiment of the present disclosure.
Figure 2:
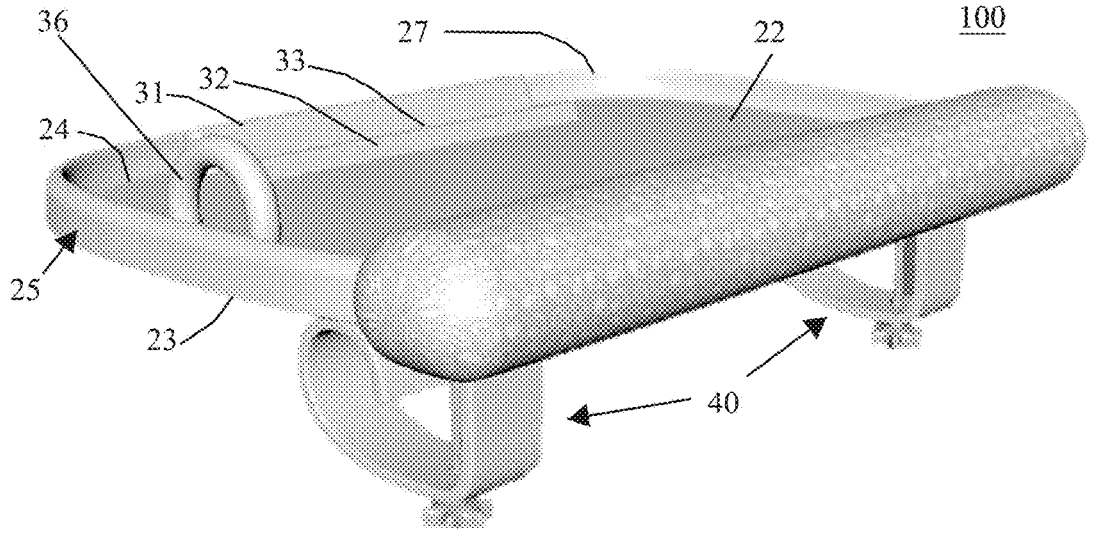
FIG. 2 is an illustration of a back perspective view of the tray system of FIG. 1.

Embodiments of the present disclosure are described in detail with reference to the drawings, in which like reference numerals designate identical or corresponding elements in each of the several views.

As used herein, the term "distal" refers to the portion of the component being described which is further from a user, and the term "proximal" refers to the portion of the component being described which is closer to the user.

The present disclosure relates to tray and more specifically to a tray system directed to be used by younger children. Additionally, the present disclosure relates to the features and elements included in the tray system.

Referring to FIG. 1, a tray system in accordance with the present disclosure is shown generally as 100. The tray system 100 generally includes a tray 20, fixing elements 30, at least one anchoring system 40, and a pad 10. The pad 10 is an elongated pad, in instances, tubular, and is connected to a proximal end 21 of the tray 20. More specifically, the pad 10 can be substantially circular shape having a substantially circular transverse cross-sectional profile. Pad 10 is connected to a retaining flange (not shown) and disposed horizontally along the proximal end 21. While the pad 10 is shown and described as having a circular transverse cross-section, it is contemplated that the pad 10 may have any cross-sectional shape, including and not limited to D-shaped, triangular, etc.

In embodiments, it may be desired to have the pad 10 made of a resilient and/or soft material such as a foam, and to cover have the pad 10 covers by an elastic substrate or sleeve fabricated from or another suitable textile material. The resiliency of pad 10 is an import feature which may reduce bruising of a child for instances when a child may come in contact with the tray system 100 in an abrupt manner. Additionally, the pad 10 may serve as a cushion for the tray system 100 when stored. In a different embodiment, it may be desired to have the pad 10 to be configured in such a way that a user may replace a worn out pad 10 by a new pad 10. In instances, the pad 10 can be a reusable pad 10 or may include an outer substrate which may be replaceable and/or made of an absorbent material such as an absorbent fabric, or foam (e.g., sponge) designed to maximize absorbency and holding capacity of a fluid spilled thereon.

In another example, it may be desired to have pad 10 manufactured of a solid material like plastic or metal in order to increase durability and to reduce wearing. For instance, when pad 10 is a metallic pad 10, the pad 10 may be machined out of a light and soft metal having magnetic properties enabling a user to attach figures or elements including magnets onto a surface of pad 10. It may further be desired to have a hollow pad 10 where parents or a user can store relatively small items like miniature toys, figures, towels, wipes, fixing elements 30, etc., therein.

It is understood, if desired, the pad 10 can be permanently affixed to the tray 20 via any suitable adhesive or bonded via epoxy cement, glue or well known in the art fusion technics such as thermal fusion. Additionally, it is understood that the pad 10 may be included in system tray 100 using well known in the art manufacturing technics such as injection molding, additive manufacturing, or others, for example, where the tray 20 is formed along the pad 10.

Referring now to FIGS. 1-4, in general, the tray 20 is substantially rectangular with rounded edges and slightly arced sides, or in selected embodiments the tray 20 may have a square or oval shaped configuration. Tray 20 defines a top surface 22 and bottom surface 23, top surface 22 and a bottom surface 23 opposed to top surface 22. Further, top surface 22 defines a periphery 24 from where a lip 25 extends substantially upwards. More specifically, lip 25 extends away from the top surface 22. The lip 25 generally includes a U-shape transverse cross-sectional configuration and defines an underneath channel 26 and a top rounded surface 27 which includes a dull edge 28.

Still with reference to FIGS. 1-4, top surface 22 of tray 20 is substantially flat and smooth, and is configured to bear items thereon, such as utensils, dishes, toys, and the like. Tray 20 may further include one or a combination of coatings such as a child friendly coatings, a non-toxic coating, a nonslip coating, or a ruggedize coating to stop items placed thereof from sliding. In selected embodiments, it may be desired to further include elements configured to assist top surface 22 to stop items placed thereof from sliding, and up to an extend further restrict an item's mobility with respect to system tray 100. Such elements are generally labeled fixing elements 30, fixing elements 30 can be included in top surface 22 during manufacturing or can be removably attached thereto. For example, tray 20 may be manufactured using well known in the art manufacturing technics such as injection molding, additive manufacturing, or others, in where fixing elements 30 are formed/manufactured at the same time as the top surface 22. In another example, fixing elements 30 and tray 20 may be separately manufactured in such a way where fixing elements 30 can be connect to tray 20 post-manufacturing, e.g., fixing elements 30 may be bolded or glued onto top surface 22.

In selected embodiments fixing elements 30 may include a first protrusion 31, second protrusion 32, and a loop 34 which extend away from top surface 22. First protrusion 31 and second protrusion 32 are trapezoidal or rectangular protrusions, horizontally disposed onto top surface 22, and have substantially elongated configurations. Further, first protrusion 31 and second protrusion 32 can be configured to support a media device such as a tablet or smart phone in such a way where first protrusion 31 and second protrusion 32 are disposed, along tray 20, and are disposed parallel to one another, first and second protrusions 31 and 32 are spaced apart from one another and define a channel 33 therebetween. In other words, channel 33 is defined by first and second protrusions 31, 32, and by top surface 22, and are configured and dimensioned to hold a media device thereon. First protrusion 31 defines a height, and second protrusion 32 defines a height which is less than the height of first protrusion 31. Additionally, it is contemplated that first protrusion 31 includes a proximal wall (e.g., wall facing second protrusion 32) which angles away from second protrusion 32.

While in use, a media device connects to channel 33 (e.g., between first and second protrusions 31 and 32) in such a way that channel 33, in combination with first and second protrusions 31 and 32, enables placement and hands-free upstanding the media device, such as computer tablet while a child, sitting near the proximal end 21 of tray 20, watches a video thereof.

Still in selected embodiments, loop 34 includes a substantially circular tubular body 35 which defines an opening 36 therethrough. As illustrated in FIGS. 1-4, loop 34 may be located adjacent at least one lateral side edge of tray 20. Loop 34 may be located between first and second protrusions 31 and 32, and pad 10. While in use, a parent can connect or tether a toy to the loop 34 which may limit the movement of the toy and further prevent a toy from touching the contaminated floor at instances where a child may be actively playing with the toy.

With continued reference to FIGS. 1-4, tray system 100 additionally includes connection elements, such as the anchoring system 40. In general anchoring system 40 is configured to connect tray 20 to a flat surface such as a table top. Anchoring system 40 includes a pair of clamps each having a proximal anchoring portion 41 and a distal anchoring portion 42 which is resilient. The proximal anchoring portion 41 of each clamp is configured as a G-shaped clamp including a proximal frame 44 having a C-shape like configuration which defines a first end 44*a* and a second end 44*b* (FIG. 4), which are opposed to one another. At the first end 44*a*, the frame 44 includes a fixed jaw 45, and near the second end 44*b*, the frame 44 includes a movable jaw 48 having a threaded hole formed therein and defining an opening 46. The opening 46 is configured to receive a corresponding screw 47 and further defines a central axis "A" which is perpendicular to the fixed jaw 45. In other words, the screw 47 is operably connected to the threaded hole which defines the opening 46. The screw 47 defines two opposed ends, a first end 47*a* which is closer to the fixed jaw 45 and connected to movable jaw 48, and a second end 47*b* which is connected to or supports a knob 51. While in use, a user can rotate the screw 47 in one selected direction by rotating the knob 51 which, when being rotated, generates advancement of the screw 47 through the opening 46 while reducing the distance between the movable jaw 48 and the fixed jaw 45. Movable jaw 48 includes a contact surface 49 which may be padded and slightly parallel to the fixed jaw 45.

Figure 3:
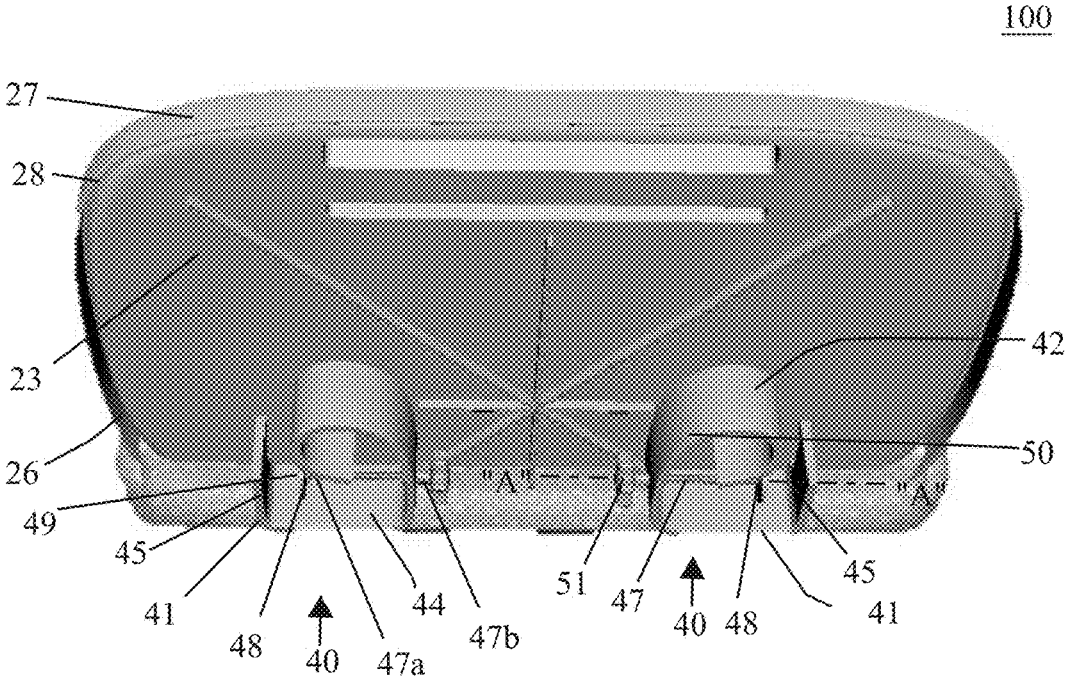
FIGS. 3 and 4 are illustration of a bottom perspective view of the tray system of FIG. 1.
Figure 4:
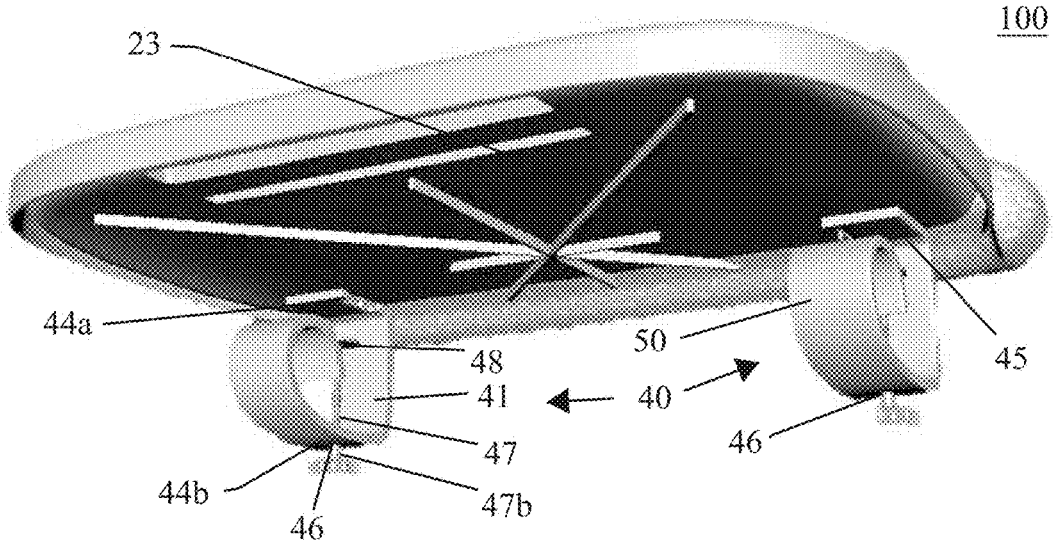

Still in reference to FIGS. 3 and 4, movable jaw 48 of each clamp of anchoring system 40 further includes a resilient arm 50 which may additionally assist fixed jaw 45 to anchor the tray system 100 to a flat surface. Each resilient arm 50 is located at a distal portion of movable jaw 48 of each clamp of anchoring system 40, and is connected to frame 44 at the second end 44*b* thereof. Each resilient arm 50 may include a spiral-like or pigtail configuration as seen in FIGS. 1-4.

In use, each clamp of anchoring system 40 is configured to receive a flat panel (e.g., table top) therebetween, more specifically, fixed jaw 45 may contact one surface of the flat panel while the resilient arm 50 may contact the opposite surface of the flat panel exerting a first compression force onto the flat panel. In other words, a user may slide a flat panel between the fixed jaw 45 and the resilient arm 50. After advancement of the screw 47, the movable jaw 48 may additionally connect to the opposite surface of the flat panel exerting a second compression force onto the flat panel; the second compression force can be managed by rotation of the knob 51.

In embodiments, it may be desired to have each clamp of anchoring system 40 hinged to the bottom surface 23 in order to increase portability, storability and stowability of system tray 100. It is understood that each clamp of anchoring system 40 may be hinged to the bottom surface 23 using any type of hinge, such as, for example, flush hinge, knuckle hinge, lift-join butt hinge, living hinge, or the like. Each clamp of anchoring system 40 is generally disposed adjacent the proximal end 21 of tray 20 and may independently fold towards or away the center of the tray 20, depending of the location of the hinge. While in use and prior to connecting the tray system 100 to a flat surface, each clamp of anchoring system 40 is generally in a folded position, see FIG. 3. A user may exert a pulling force on each clamp of anchoring system 40 sufficient to move each clamp from a folded state/position (FIG. 3) to an extended state/position (FIG. 4). In response to the pulling force exerted to each clamp of anchoring system 40, each clamp will move away from the surface 23 of tray 20 until each one of the fixed jaw 45 is substantially parallel to the surface 23 of tray 20. It is contemplated that in selected embodiments, for storing purposes, each clamp of anchoring system 40 may be releasable, in other words, each clamp may detach from the tray 20.

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Therefore, the above description should not be construed as limiting, but merely as exemplifications of particular embodiments. Those skilled in the art will envision other modifications within the scope of the claims appended hereto.

It is contemplated that the system and examples described in the present disclosure may be implemented to currently available tray systems directed to be used by children or others.

What is claimed is:

1. A tray system, including:

a tray defining a bottom surface, a top surface, a proximal end, and a distal end;

a pad configured to couple to the proximal end of the tray, the pad having a substantially cylindrical shape;

a lip having a U-shaped configuration, the lip extending away from the top surface of the tray, the lip located adjacent a periphery of the bottom surface of the tray;

a plurality of fixing elements extending from the top surface of the tray, the plurality of fixing elements including:

a pair of substantially elongated protrusions extending away from the top surface; and a circular loop;

an anchoring system hinged to the bottom surface of the tray and configured to connect to opposed surfaces of a substantially flat surface, the anchoring system including at least one clamp, each clamp including:

a proximal portion having a C-shaped frame defining a first end;

a distal portion integrally connected to and extending from the proximal portion, the distal portion defining a G-shaped clamp and configured as a resilient arm; and a screw threadably connected to the resilient arm.

2. The tray system of claim 1, wherein the anchoring system includes a pair of clamps hingedly connected to the bottom surface of the tray.

3. The tray system of claim 1, wherein the plurality of fixing elements are removable.

4. The tray system of claim 3, wherein the pad is hollow and is configured and dimensioned to store the plurality of removable fixing elements.

5. The tray system of claim 1, wherein each clamp of the anchoring system is foldable between a collapsed condition and an extended condition.

6. The tray system of claim 1, wherein the pair of substantially elongated protrusions of the plurality of fixing elements includes:

a first elongated protrusion disposed adjacent the distal end of the tray; and a second elongated protrusion disposed adjacent the first elongated protrusion.

7. The tray system of claim 6, wherein the first elongated protrusion and the second elongated protrusion of the plurality of fixing elements are spaced apart from one another and extend parallel to one another.

8. The tray system of claim 7, wherein the first elongated protrusion and the second elongated protrusion of the plurality of fixing elements extend substantially parallel to the distal end of the tray.

9. The tray system of claim 8, wherein the first elongated protrusion of the plurality of fixing elements has a height, and the second elongated protrusion of the plurality of fixing elements has a height which is less than the height of the first elongated protrusion.

10. The tray system of claim 9, wherein the first elongated protrusion of the plurality of fixing elements includes a proximal wall facing the second elongated protrusion of the plurality of fixing elements, wherein the proximal wall is angled and extends away from the second elongated protrusion of the plurality of fixing elements.

11. The tray system of claim 10, wherein the circular loop of the plurality of fixing elements is located adjacent a lateral side edge of the tray.

12. The tray system of claim 11, wherein the circular loop of the plurality of fixing elements is located between first and second protrusions of the plurality of fixing elements and the pad.

13. The tray system of claim 2, wherein a first clamp of the pair of clamps of the anchoring system is located adjacent a first lateral side of the tray, and a second clamp of the pair of clamps of the anchoring system is located adjacent a second lateral side of the tray.

14. The tray system of claim 13, wherein each clamp of the anchoring system is foldable between a collapsed condition and an extended condition.

15. The tray system of claim 14, wherein the pair of substantially elongated protrusions of the plurality of fixing elements includes:

a first elongated protrusion disposed adjacent the distal end of the tray; and a second elongated protrusion disposed adjacent the first elongated protrusion.

16. The tray system of claim 15, wherein the first elongated protrusion and the second elongated protrusion of the plurality of fixing elements are spaced apart from one another and extend parallel to one another.

17. The tray system of claim 16, wherein the first elongated protrusion and the second elongated protrusion of the plurality of fixing elements extend substantially parallel to the distal end of the tray.

18. The tray system of claim 17, wherein the first elongated protrusion of the plurality of fixing elements has a height, and the second elongated protrusion of the plurality of fixing elements has a height which is less than the height of the first elongated protrusion.

19. The tray system of claim 18, wherein the first elongated protrusion of the plurality of fixing elements includes a proximal wall facing the second elongated protrusion of the plurality of fixing elements, wherein the proximal wall is angled and extends away from the second elongated protrusion of the plurality of fixing elements.

20. The tray system of claim 19, wherein the circular loop of the plurality of fixing elements is located adjacent a lateral side edge of the tray, and wherein the circular loop of the plurality of fixing elements is located between first and second protrusions of the plurality of fixing elements and the pad.

* * * * *